United States Patent [19]

Pratt

[11] 4,222,458

[45] Sep. 16, 1980

[54] BASEMENT EMERGENCY EXIT

[76] Inventor: James W. Pratt, 2080 Joliet St., Aurora, Colo. 80010

[21] Appl. No.: 60,415

[22] Filed: Jul. 25, 1979

[51] Int. Cl.[3] ..... E06C 1/34; E06C 9/10

[52] U.S. Cl. ..... 182/81; 182/95

[58] Field of Search ..... 182/81, 77, 95, 78

[56] References Cited

U.S. PATENT DOCUMENTS

| | | | |
|---|---|---|---|
| 145,844 | 12/1873 | Chipley | 182/77 |
| 527,852 | 10/1894 | Grosse | 182/81 |
| 937,710 | 10/1909 | Mowrey | 182/95 |
| 2,393,759 | 1/1946 | Eakin | 182/81 |
| 3,055,452 | 9/1962 | Bourdunis | 182/95 |

*Primary Examiner*—Reinaldo P. Machado
*Attorney, Agent, or Firm*—Richard D. Law

[57] ABSTRACT

A folding stairway interconnected with a basement window and its lock, for unlocking the window and opening the window when the stairs are pivoted from a closed or folded position to a down, usable position.

12 Claims, 10 Drawing Figures

BASEMENT EMERGENCY EXIT

This invention relates to an emergency exit from below ground level basements, with high windows, including a foldable set of stairs connected to a window so that the window is unlocked and opened as the stairs are pulled down from folded to usable position.

BACKGROUND AND PRIOR ART

Many houses are built with a below ground level basement, and, as building technics have changed, the basement areas are more frequently used for living areas. Particularly where the basement may be kept dry, it adds a considerable amount of inexpensive floor area to a residence. As the usual place for a furnace and a hot water heater is in a basement, a potential hazard for occupants of the basement is apparent. Also, if a fire originates in a basement, the usual path for the smoke and flames is up the stairwell to the next higher level, generally blocking the only exist from the basement.

Usual basement windows are not only small, but are high and difficult to open. Adults have a difficult time in escaping from the basement by conventional basement windows, and children find it virtually impossible. Smoke is one of the greatest hazards as it blinds persons, and in such a confined place as a basement, chokes and sufficates them. Escape from a basement filed with smoke and flames is not feasible up the stairwell due to the natural draft bringing smoke and flames up the stairwell. But escape through the normal basement window is, likewise, very difficult or impossible, especially for children.

The prior art is rather deficient in addressing the problem and providing a solution. An early patent to Mowrey U.S. Pat. No. 937,710 of Oct. 19, 1909 shows an exterior fire escape comprising a folding staircase from an upper level of a building. The folding staircase is folded against the exterior of the building and is released by releasing a lock mechanism. The door leading to staircase can not be opened until the stairs have completely unfolded to the ground.

A folding disappearing stairway from a floor level to an attic is shown in U.S. Pat. No. 2,393,759 to Eakin Jan. 29, 1946. This provides access to an upper floor, but does not show how it could be suitable for a basement.

A folding fire escape stored, on an above ground floor, inside a building adjacent a window is shown in U.S. Pat. No. 2,852,175 of Sept. 15, 1958. The escape is a scissored ladder which swings out through the window opening and it then unfolds as it drops to the ground.

A combination door and ladder for an aircraft in U.S. Pat. No. 2,558,975 to Moreno et al of July 3, 1951 shows a cable supported ladder that unfolds from the exterior of an upper level of a building to a lower ground level after the door is opened.

An emergency exit through an above ground, opened window is shown in U.S. Pat. No. 3,055,452 to Bourdunis of Sept. 25, 1962. The folded ladder is held inside the window and is pivoted to the outside for use.

THE PRESENT INVENTION

According to the present invention there is provided a folding stairway that folds flat against a vertical wall under a basement window and the stair treads pivot to a perpendicular position extending from the wall forming a stairway to the window. The treads are interconnected whereby pulling one tread down pivots all the treads. The stair tread mechanism is connected with a window lock and initial movement of the stairs unlocks the window. The same connection opens the windows as the stair motion is continued. The only action taken by a prospective user is to pull a single stair tread down. A person, even a child or a person crawling, may easily find and operate the escape means. The lock arrangement is hidden in one form, so that it may not be tampered with from the exterior. The windows are hinged to open outwardly from the basement after the lock is released for easy exit and not interfer with the user.

OBJECTS AND ADVANTAGES OF THE INVENTION

It is, therefore, among the objects and advantages of the invention to provide an escape mechanism from a below ground basement including a window and a stairway to the window.

Another object of the invention is to provide a combined folding stairway and interconnected basement window which actuates an automatic window opening when the stairs are pulled down.

Yet another object of the invention is to provide a basement emergency exit having a window and folding stairway being interconnected to a lock means for the window which unlocks as the stairs are pivoted to usuable condition.

Still another object of the invention is to provide a basement emergency exit having a window and folding stairway interconnected to automatically open the window as the stairs are pivoted to use position.

A further object of the invention is to provide a basement emergency exit which is essentially flush with a basement wall and is simple and easy to operate to provide a stairway and an automatically opening window.

These and other objects and advantages may be ascertained by reference to the following description and appended illustrations in which:

GENERAL DESCRIPTION OF THE DRAWINGS

SPECIFIC DESCRIPTION OF THE ILLUSTRATIONS

Figures 1, 2:
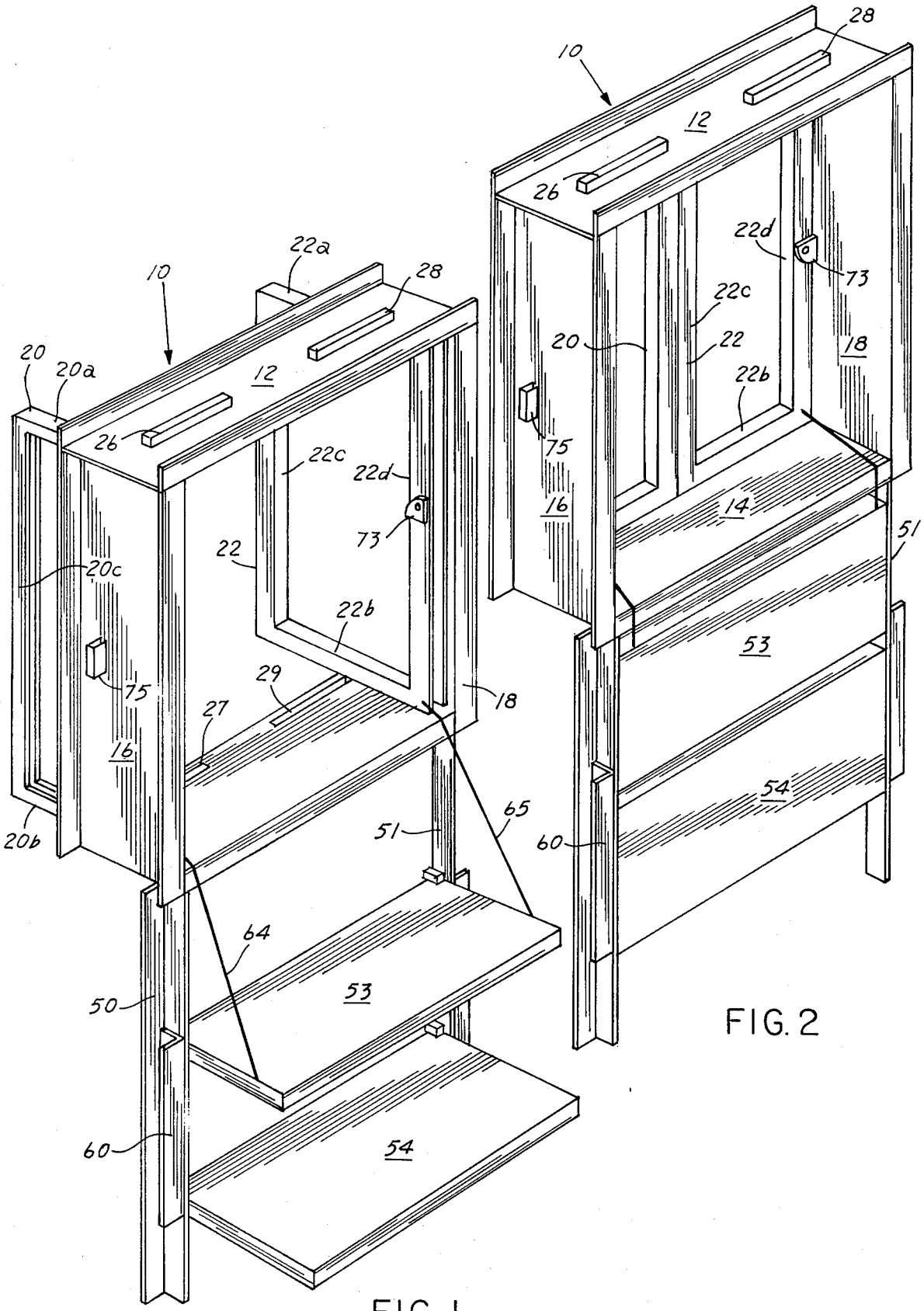
FIG. 1 is a perspective view of one preferred form of the invention in open or usable condition.
FIG. 2 is a perspective view of the device to FIG. 1 in a closed position.
Figure 3:
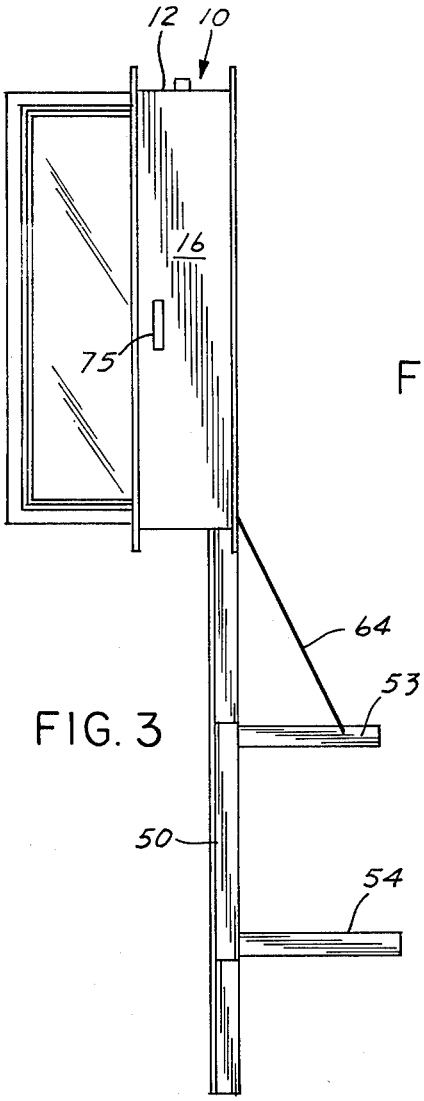
FIG. 3 is a side elevational view of the device of FIG. 1 in its open position.
Figure 4:
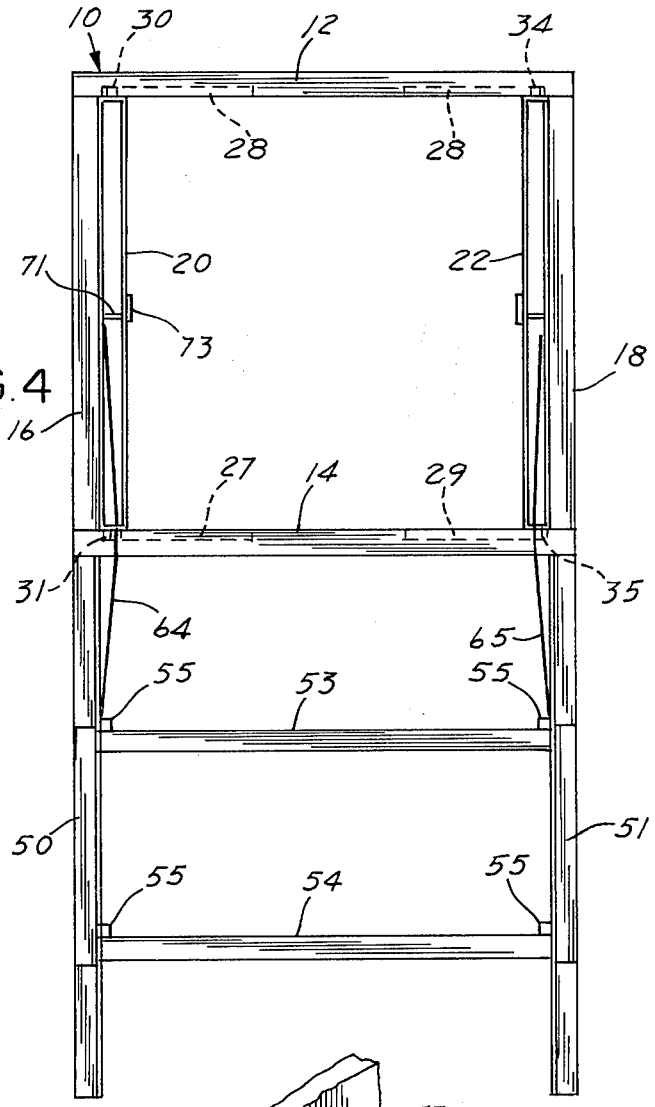
FIG. 4 is a front elevation thereof.
Figure 7:
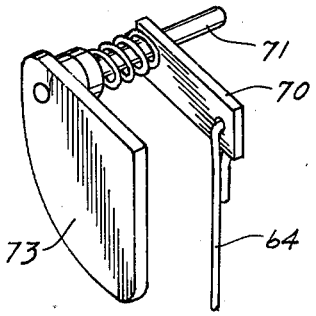
FIG. 7 is an enlarged perspective detail of a lock mechanism of the invention.

In one preferred form of the invention illustrated in the drawings, a window frame, shown generally by number 10, for a casement window. The frame includes top piece 12 and bottom piece or sill 14 joined to side pieces 16 and 18. A pair of casement windows 20 and 22 are hinged to open outwardly in the frame. The frame is set in a concrete, basement wall, and if below ground level, the earth in front of the window is removed forming a window well.

The casement windows include top and bottom rails 20*a* and 20*b* for window 20 and rails 22*a* and 22*b* for window 22. Stiles 20*c* and 20*d* complete the sash 20 and stiles 22*c* and 22*d* complete the sash 22. Each window includes upper and lower pins riding in tracks in the frame, which align with the hinge arrangement, and permitting the windows to open with a partial inward sliding of the outside stiles. Upper track 26 and lower track 27 guide upper pin 30 and lower pin 31, respectively, secured to the rails of window 20. In a similar manner, window 22 includes upper pin 34 and lower pin 35 riding respectively in tracks 28 and 29. Thus on opening a window, the exterior stile moves inwardly so that the window does not extend outwardly its full width.

Figure 9:
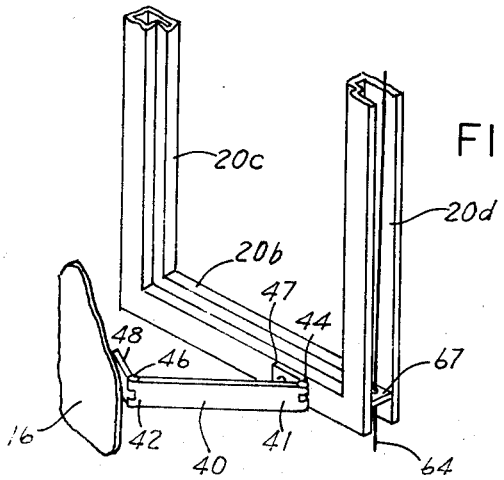
FIG. 9 is an enlarged perspective detail of a hinging arrangement according to the invention.

The hinge of the windows is a double pintle hinge permiting the outside stile to move inwardly. A hinge, FIG. 9, including a connecting link 40 is pivoted at one end 41 by pintle 44 to hinge plate 47 mounted on rail 20*b*. The opposite end 42 is pivoted by pintle 46 mounted in hinge plate 48 secured to frame side 16. This hinge arrangement allows the window pins to slide in the tracks on opening or closing the window. Each window includes at least one such hinge, and in most instances an upper and a lower hinge. The size of the window dictates the use of one or two hinges, however, the two hinge arrangement provides for easy operation and accurate alignment of the windows for operation.

The usual construction material for concrete-set basement windows is metal, and the invention has been found very satisfactory for metal windows. Other materials, such as wood, and, also, useful for the construction. Most commonly, the frame is made of sheet steel, and the windows may be steel, aluminum or the like.

The usual basement window is high, and not easily accessible from the basement floor, particularly to small children. A folding stairway is provided, which is attached to the window frame and/or the concrete wall and operates in conjunction with the window. The folding stairs are interconnected with windows so that both windows open automatically as the stairs are pulled down into usable condition. The stair treads are pivoted to the stair frame and connected together, making it easy for even a child to pull on a single tread, pivoting all the stairs down and opening the window.

A stair frame including a pair of spaced apart uprights 50 and 51 are secured in position below the window tightly abutting the basement wall. In one form, the uprights are angle irons, welded or bolted to the window frame; in another the uprights are bolted or otherwise secured in position on the basement wall below the window; and in still another form the uprights are welded to the frame and the bottom bolted to the concrete wall. The length of the uprights should span the distance from the window to the basement floor. Stair treads 53 and 54 are pivotally secured to the uprights, and suitable stops 55 stop and hold the treads in horizontal position. The stops may be welded metal pieces to steel uprights, or any other suitable stop to support persons on the treads. For normal use and appearance, the stair frame is boxed in (as by another angle) to hid the connecting mechanism.

Figure 8:
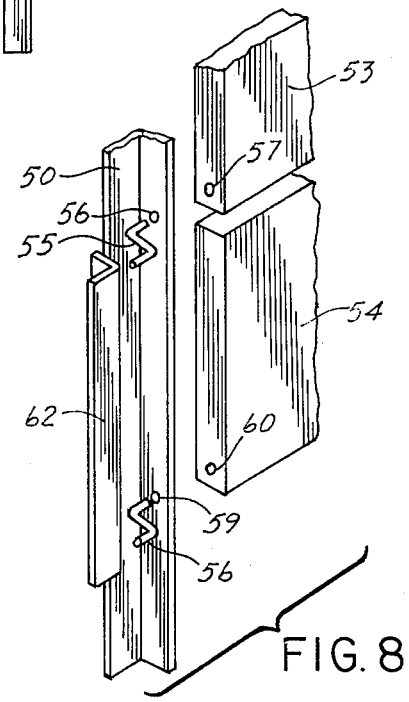
FIG. 8 is an enlarged perspective detailed view of a step coordinating system for conjoint operation of the folding stair treads of the device.
Figure 5:
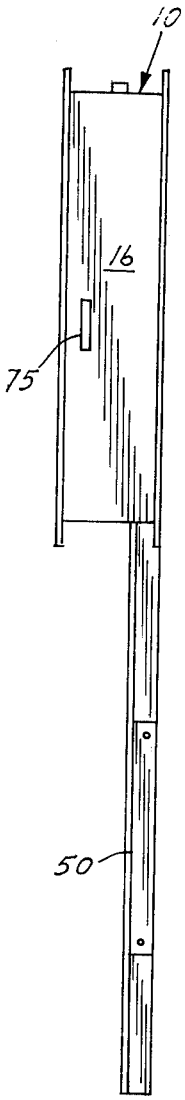
FIG. 5 is a side elevational view of the device in closed position.
Figure 6:
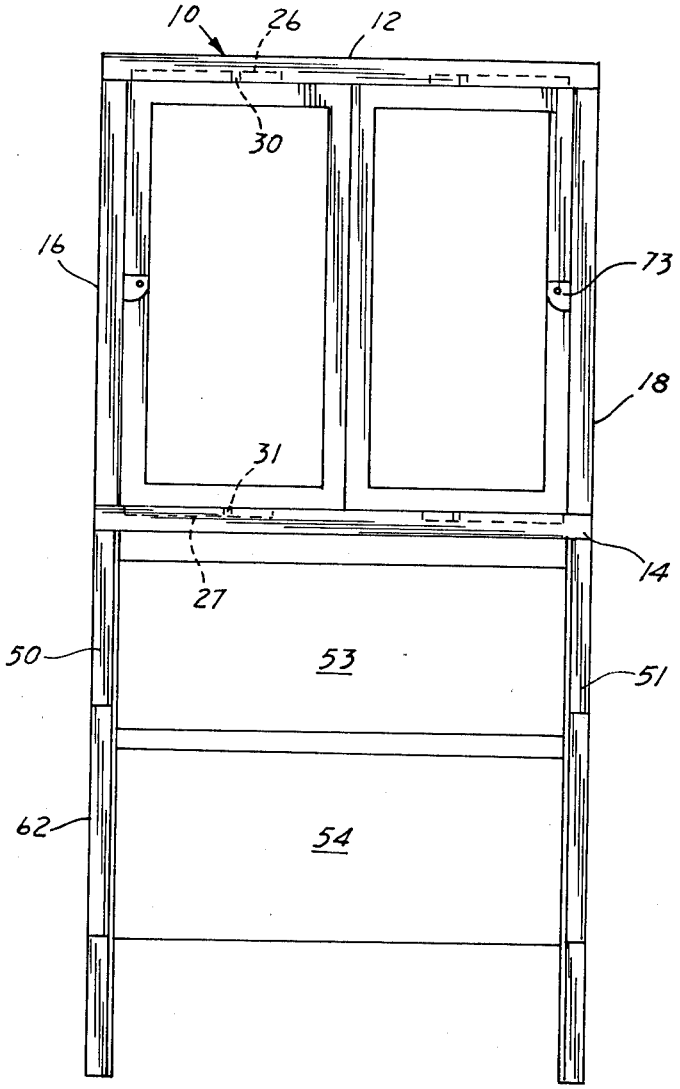
FIG. 6 is a front elevation thereof.

The treads are pivoted to the uprights by means of a leg of a crank, for example, FIG. 8, a crank 55 has a leg pass through an opening 56 in upright 50 to an opening 57 in tread 53. Tread 54 is secured by a leg of crank 56 passing through opening 59 in upright 50 to opening 60 in tread 54. Both sides of each tread are likewise, pivoted by connection to the leg of the crank. A joining bar 60 is secured to the outer end of each crank so that each tread turns the crank and thereby to cause both treads to pivot to horizontal position if either tread is pulled down.

For most installations, two treads are satisfactory, however, three or four could be used, each attached to a crank pivot and such cranks joined together by a connecting bar. Preferably, the treads should decease in width from the bottom to the top for better footing of the user. Also, since the treads are usually of metal, means on the stair treads should be provided to prevent slippage on the tread.

The windows are opened as the stairs are pulled down by means of cables 64 and 65. Each cable is secured to the top stair tread adjacent the outer end, from the pivot, and passes up over the sill 14 and along the bottom rail of the sash to a guide 67 in the lower corner of the stile, as in FIG. 9. The cable 64 then passes up the stile (usually a notch in the stile) to a lever arm 70 which is fixed to a pivot pin 71 in sides of the stile, about halfway up the window. A latch plate 73 is secured to the end of the pivot pin on the inside of the stile, and the latch plate is eccentrically mounted so that a portion will turn into a track 75 in the frame, locking the window. Both windows are equally equiped. Thus, when the stairs are pulled down, the cables 64 and 65 are pulled, rotating lever 70 and unlocking the latch plate 73, and further pulling down of the stairs pulls the windows open. Once opened, egress from the basement is easily had by even small children.

The unit is an exceptional emergency exist, since the stairs are easily pulled down to automatically open the window. Thus an occupant may exist the basement even though the windows are not discernable through heavy smoke. The operating action is of the simplest kind, a mere pull on a stair tread to pivot it to horizontal position. Also, the latch plate, with an attached handle, may be rotated from the inside to permit opening the window without actuation of the stairs. Of great importance is that the particular lock arrangement is not accessable from the exterior, and thus thwarts all excpt one who breaks the window.

Figure 10:
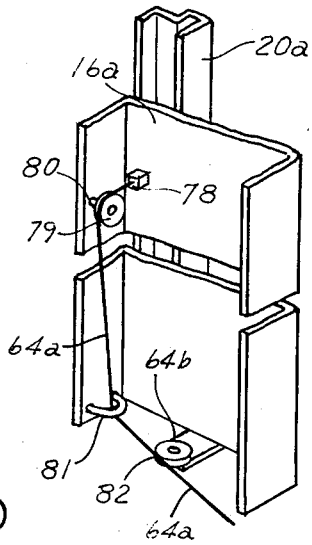
FIG. 10 is a detail, perspective of a modified window lock.

A modified lock arrangement for each sash, which is not accessible, even if the window pane is broken, is shown in FIG. 10. In this case a spring biased latch 78, similar to a spring biased door latch, is mounted in an upright 16*a* of a window frame in position to move into is a slot (not shown) in a frame stile 20*d*. A cable 64*a* passes over pulley 79 mounted on shaft 80 in the frame and is secured to the bolt style latch 78. The cable 64*a* passes through eyelet 81 mounted on the window frame and across pulley 82. The cable extends down to the stair tread, as above. A second cable portion 64*b* is connected to cable 64*a* so as to move with it across the pulley 82. The end of the cable 64*b* is secured to the lower sash pin (not shown) so that the window is opened as the cable 64*a* is pulled by the decending stair tread.

The combination of the window and the stair treads provides a simple and easy egress from the basement. Various locking means for the windows will be obvious to those skilled in the art, and changes in window unlocking and opening means will be apparent as substitutes for the mechanisms shown. Such variations are intended to be included within the scope of the invention and the appended claims.

What is claimed is:

1. An emergency basement exit opening to a ground level agress comprising, a window having at least one sash hinged to swing outwardly providing exit for an adult, a folding stairway secured adjacent said window providing accessability to said window in the down position and including a frame abutting the wall below said window and at least one tread pivoted along one edge mounted on said frame movable from a flush position with said frame to a perpendicular position therewith, and means interconnecting said at least one sash and said at least one tread constructed and arranged to open said hinged window when said at least one tread is pivoted to a perpendicular position with said frame.

2. An emergency basement exit according to claim 1, wherein said at least one sash includes a double pintle hinge with a link therebetween, upper and lower pins for reciprocating in tracks in the window frame whereby the sash opens by pivoting partially inwardly and opens against the window frame.

3. An emergency basement exit according to claim 2, wherein said sash includes lock means interconnected with said means interconnecting said sash and said at least on tread whereby said lock is unlocked as said at least one tread is initially pivoted.

4. An emergency basement exit according to claim 3, wherein said window includes two hinged sashes both interconnected to said at least one tread and both arranged to open as said at least one tread is pivoted downwardly.

5. An emergency basement exit according to claim 1, wherein said means interconnecting said at least one sash and said at least one tread is a cable secured to said at least tread so as to pull and at least one sash in open position as said at least one tread is pivoted downwardly.

6. An emergency basement exit according to claim 5, wherein said window includes two hinged sashes and a cable is secured to each sash and to said at least one tread whereby both sashes are opened as said at least one tread is pivoted downwardly.

7. An emergency basement exit according to claim 1, wherein said at least one tread includes multiple treads interconnected together so that all treads pivot in unison.

8. An emergency basement exit according to claim 7, wherein said multiple treads are of gradually reduced width from bottom to top tread.

9. An emergency basement exit according to claim 1, wherein said at least one sash is hinged at the top and at the bottom thereof and said hinges are secured to the upright sides of the frame of said window.

10. An emergency basement exit according to claim 1, wherein said at least one sash includes a pivoted latch arm arranged to pivot into a notch in the window frame and said means interconnecting said at least one sash is connected to a lever arm on said latch arm whereby first pivotal movement of said at least one tread pivots said latch arm open and permits said sash to open on further pivoting of said at least one tread.

11. An emergency basement exit opening to ground level egress comprising, a window frame with two hinged sashes opening outwardly providing exit for an adult, a folding stairway secured in position below said window frame, including a pair of upright standards and two treads pivoted on one edge to said standard and spaced apart to pivot flat between said standards, and said treads being secured together for conjoint pivoting, a cable secured to each outer edge of the upper of said two treads at a position spaced from the pivot of said tread and secured to the sash adjacent the outer edge of the tread so that pivoting said treads from folded position pulls each said cable opening both said sashes.

12. An emergency basement exit opening to ground level egress according to claim 11, wherein each said sash includes locking means, and each said calbe is secured to said locking means so that each said locking means is unlocked as said treads are pivoted downwardly.

* * * * *